US005953781A

United States Patent [19]

Sletten, II et al.

[11] Patent Number: 5,953,781

[45] Date of Patent: Sep. 21, 1999

[54] ADJUSTABLE HANDLE ASSEMBLY FOR FLOOR MAINTENANCE MACHINES

[75] Inventors: William Charles Sletten, II, Eden Prairie; Mark Joseph Sowada, Eagan; Kurt M. Vetse, Plymouth; Donald J. Legatt, St. Michael; David W. Wood, Maple Plain, all of Minn.

[73] Assignee: Nilfisk-Advance, Inc., Plymouth, Minn.

[21] Appl. No.: 08/540,673

[22] Filed: Oct. 11, 1995

[51] Int. Cl.[6] ..... A47L 11/16

[52] U.S. Cl. ..... 15/50.3; 15/144.3; 15/144.4

[58] Field of Search ..... 15/49.1, 50.1, 15/50.3, 144.3, 144.4; 16/115

[56] References Cited

U.S. PATENT DOCUMENTS

| | | | |
|---|---|---|---|
| D. 305,544 | 1/1990 | Ganter . | |
| 1,716,586 | 6/1929 | Julian . | |
| 1,772,361 | 8/1930 | Mross et al. . | |
| 1,958,602 | 5/1934 | Allen et al. . | |
| 2,358,119 | 9/1944 | Wilson . | |
| 2,618,798 | 11/1952 | Ohrt . | |
| 2,630,509 | 3/1953 | Arones . | |
| 2,693,716 | 11/1954 | Ludwig . | |
| 2,919,332 | 12/1959 | Descarries . | |
| 3,027,581 | 4/1962 | Holt . | |
| 3,217,351 | 11/1965 | Hayba . | |
| 3,264,674 | 8/1966 | Doyle, Jr. et al. | 15/50.1 |
| 3,411,170 | 11/1968 | Kingsley . | |
| 3,412,415 | 11/1968 | Brab . | |
| 3,798,697 | 3/1974 | Lowder et al. . | |
| 4,174,473 | 11/1979 | Brenneman . | |
| 4,198,721 | 4/1980 | Copeland . | |
| 4,435,870 | 3/1984 | Tucker et al. . | |
| 4,542,551 | 9/1985 | Phillips . | |
| 4,756,042 | 7/1988 | Genovese et al. | 15/49.1 |
| 4,900,881 | 2/1990 | Fischer . | |
| 5,261,140 | 11/1993 | Szymanski . | |
| 5,298,080 | 3/1994 | Von Vett | 15/49.1 |
| 5,327,610 | 7/1994 | Smith . | |
| 5,369,236 | 11/1994 | Nickels, Jr. . | |
| 5,674,120 | 10/1997 | Legatt et al. | 15/49.1 |

OTHER PUBLICATIONS

HILD Super Deluxe Floor Machine, Form 1020, Feb. 3, 1983, HILD Floor Machine Company, Inc., Chicago, Illinois.

HILD Pro–II Series Parts Bookley, Form 1068, Jun. 1984, HILD Floor Machine Company, Inc., Chicago, Illinois.

Clarke American Sander 16, Form 555050–4, Feb. 1986, Clarke Industries, Inc., St. Louis, Missouri.

Clarke VantageLine VP16, VP18, VP20 Polishers, Form 555096–7, Mar. 1987, Clarke Industries, Inc., St. Louis, Missouri.

Powr–Flite Commerical Floor Care Equipment Catalog, Jan. 1995, Southwest Manufacturers, Inc., Ft. Worth, Texas.

Advance Aquamatic Selectric models 263501, 263510 Parts List, Form 042271, Revised Aug. 1993, Advance Machine Company, Plymouth, Minnesota.

*Primary Examiner*—James F. Hook

*Attorney, Agent, or Firm*—Alan Kamrath; Oppenheimer Wolff & Donnelly LLP

[57] ABSTRACT

A handle assembly (10) for a floor maintenance machine (12) includes a hollow handle pole (26), a handle (84) formed of a foamed polymer, and a device (36) for adjustably locking the handle pole (26) relative to the housing (14) of the floor maintenance machine (12). The locking device (36) includes a foot-operated lever (44) of a stamped, generally U-shape. The handle (84) is formed of a top section (90) and a bottom section (92), with hand grips (156) being integrally formed solely with the top section (90). Pivotable triggers (120) are pivotally mounted to cylindrical pivot bosses (118) formed in the handle (84), with unintentional pivoting of the triggers (120) being prevented by a slideably mounted, lock-out device (164). Trapezoid-shaped extensions (106) are formed on the bottom section (92) and include edges (108) for abutting with the floor when the handle assembly (10) is tipped to reduce the risk of the handle (84) cracking at the upper end of the handle pole (26).

21 Claims, 3 Drawing Sheets

ADJUSTABLE HANDLE ASSEMBLY FOR FLOOR MAINTENANCE MACHINES

BACKGROUND

The present invention generally relates to floor maintenance machines and particularly to handle assemblies for floor maintenance machines.

The sale of floor maintenance machines is highly competitive. Thus, there is always a need to minimize the cost of floor maintenance machines while maximizing the features present. Features such as locking out unintentional actuation of the floor maintenance machine increase the marketability but can increase costs due to increased complexity of the floor maintenance machine. Cost reductions can be accomplished by several methods including reducing the number of components, increasing the ease of assembly, reduction in the costs of manufacture of the components including but not limited to reduction in capital costs such as for molds, fabrication from less expensive material, and the like.

It is then an object of the present invention to provide a novel handle assembly for floor maintenance machines.

It is further an object of the present invention to provide a novel handle assembly including a novel device for adjustably locking the handle in one of a plurality of pivotable positions relative to the machine housing.

It is further an object of the present invention to provide a novel handle assembly having a novel foot-operated lever.

It is further an object of the present invention to provide a novel handle assembly having a foot-operated camming lever maintained in a desired position relative to the handle pole.

It is further an object of the present invention to provide a novel handle assembly having a novel lock-out device for preventing unintentional actuation of the floor maintenance machine.

It is further an object of the present invention to provide a novel handle assembly having a lock-out device slideable in a straight, linear direction.

It is further an object of the present invention to provide a novel handle assembly having a lock-out device including integral biasing members.

It is further an object of the present invention to provide a novel handle assembly aiding in the prevention of cracking of the handle housing at its interconnection to the handle pole.

It is further an object of the present invention to provide a novel handle assembly having oppositely extending hand grips integrally formed solely with one housing section.

It is further an object of the present invention to provide a novel handle assembly having a significantly reduced number of components.

It is further an object of the present invention to provide a novel handle assembly which is easy to assemble.

It is further an object of the present invention to provide a novel handle assembly having reduced costs of manufacture.

It is further an object of the present invention to provide a novel handle assembly having integral hand grips of a solid construction.

These and further objects and advantages of the present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 1:
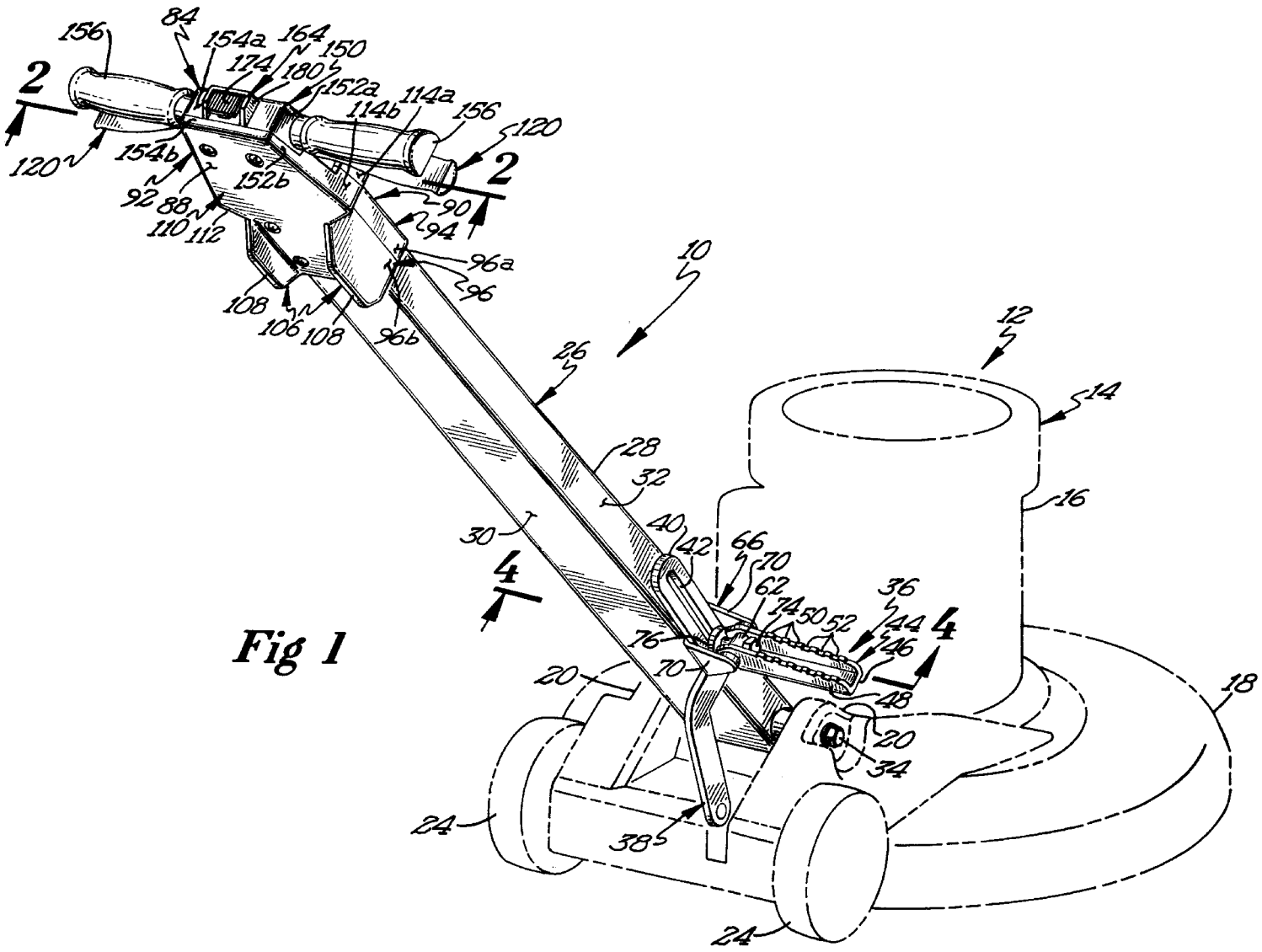
FIG. 1 shows a rear perspective view of a floor maintenance machine including a handle assembly according to the preferred teachings of the present invention, with portions shown in phantom.
Figure 2:
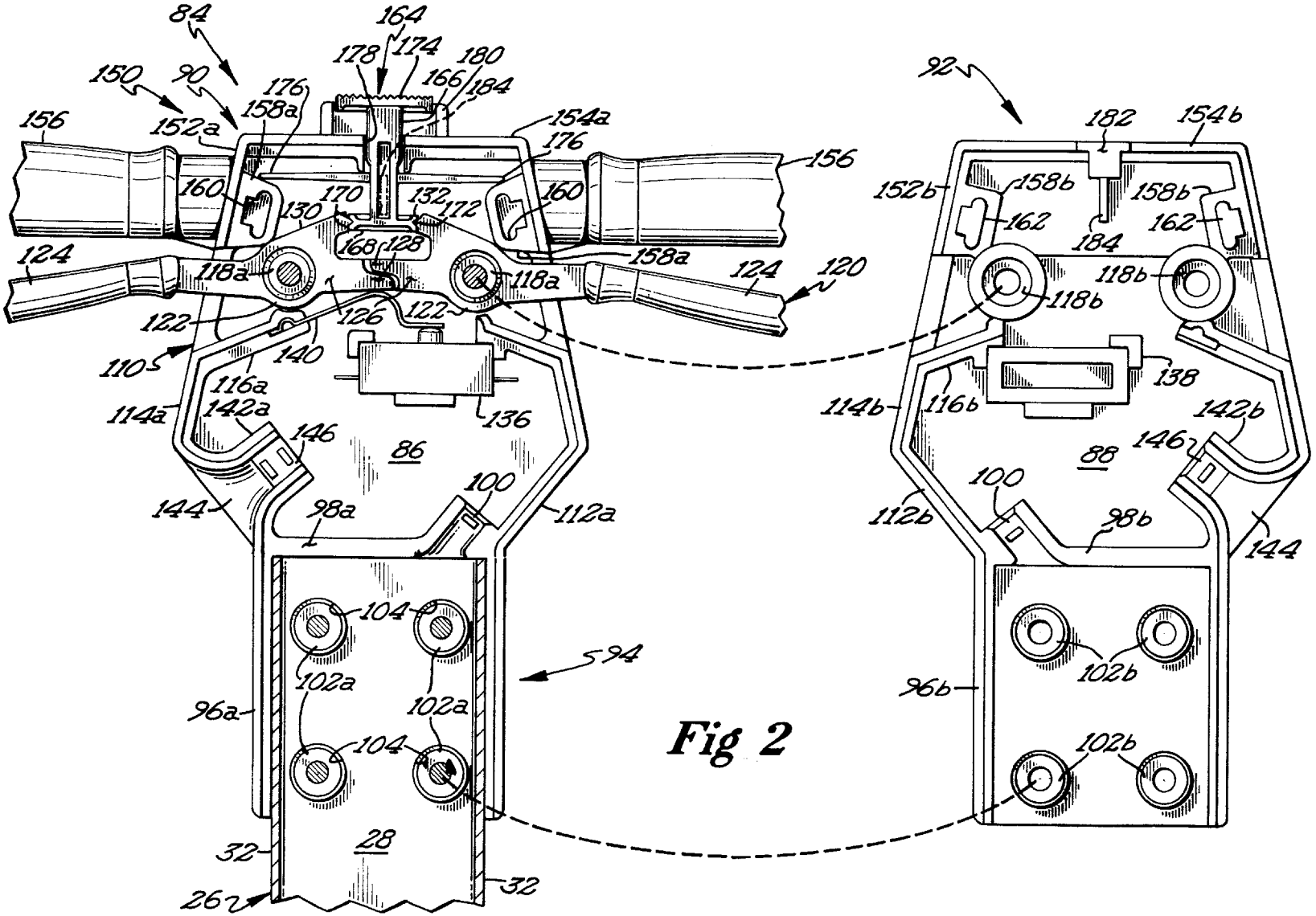
FIG. 2 shows a cross-sectional view of the handle assembly of FIG. 1 according to section line 2—2 of FIG. 1, with the bottom portion of the handle being shown as exploded therefrom and rotated 180° to show internal construction.
Figure 3:
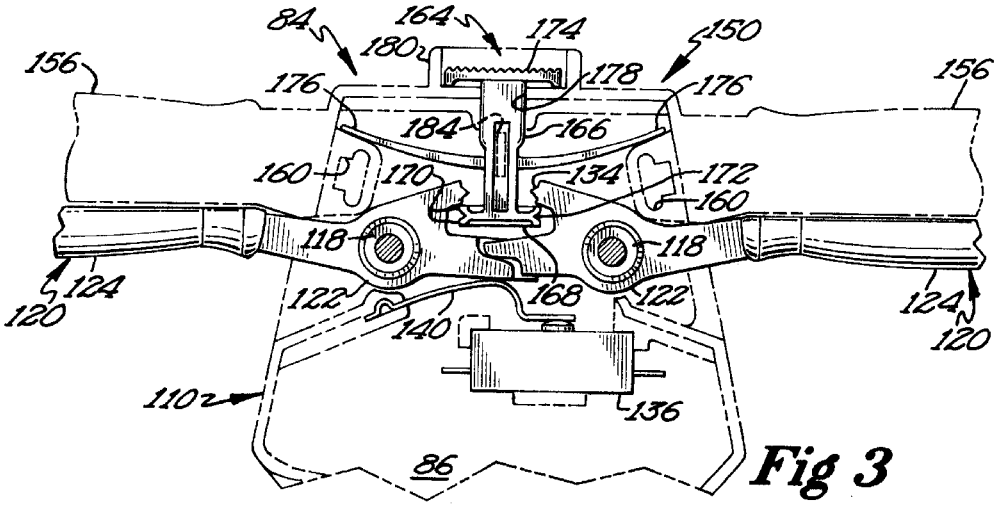
FIG. 3 shows a partial, cross-sectional view of the handle assembly of FIG. 1 in an actuation condition.
Figure 4:
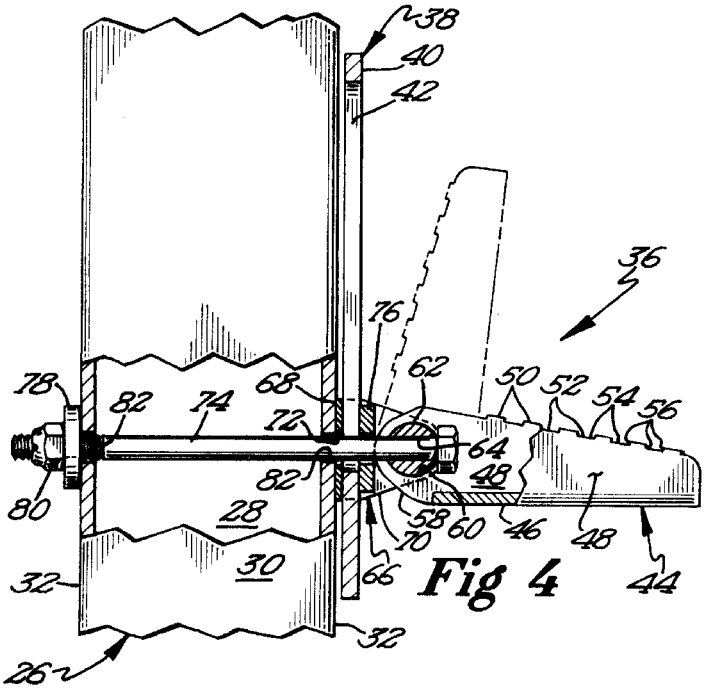
FIG. 4 shows a cross-sectional view of the handle assembly of FIG. 1 according to section line 4—4 of FIG. 1.

All figures are drawn for ease of explanation of the basic teachings of the present invention only; the extensions of the Figures with respect to number, position, relationship, and dimensions of the parts to form the preferred embodiment will be explained or will be within the skill of the art after the following description has been read and understood. Further, the exact dimensions and dimensional proportions to conform to specific force, weight, strength, and similar requirements will likewise be within the skill of the art after the following description has been read and understood.

Where used in the various figures of the drawings, the same numerals designate the same or similar parts. Furthermore, when the terms "top", "bottom", "first", "second", "inside", "outside", "front", "back", "face", "outer", "inner", "upper", "lower", "height", "width", "length", "thickness", "end", "side", "horizontal", "vertical", "axial", "radial", and similar terms are used herein, it should be understood that these terms have reference only to the structure shown in the drawings as it would appear to a person viewing the drawings and are utilized only to facilitate describing the illustrative embodiment.

DESCRIPTION

An adjustable handle assembly according to the preferred teachings of the present invention for use in floor maintenance machines is shown in the drawings and generally designated 10. Floor maintenance machine 12 of the preferred form shown includes a housing 14 having a substantially cylindrical top section 16 enclosing an electric drive motor and an enlarged circular downwardly curving base section 18. Base section 18 surrounds the upper portion of a rotary floor maintenance element such as a rotary brush or pad holder arranged to rotate about a vertical axis and in contact with the floor. Base section 18 includes parallel, spaced, handle pivot ears 20. Suitable transport wheels 24 can be provided on housing 14.

Handle assembly 10 generally includes an elongated hollow handle pole or tube 26 in the most preferred form having generally rectangular cross sections. In particular, tube 26 includes a front plate 28, a rear plate 30 parallel to and spaced from front plate 28, and first and second, spaced, parallel side plates 32 extending generally perpendicular between plates 28 and 30. The lower end of handle tube 26 is pivotally mounted to housing 14 such as by a pivot pin 34 extending through pivot ears 20, side plates 32, and the interior of handle tube 26 parallel to and intermediate plates 28 and 30. The pivot axis defined by pivot pin 34 is at a location spaced from the floor.

Handle assembly 10 in the preferred form includes a device 36 for adjustably locking handle tube 26 in one of a plurality of pivotable positions relative to housing 14. According to the preferred teachings of the present invention, device 36 includes a handle arm latch 38 of a generally Z-shape. Latch 38 includes an elongated planar portion 40 having a width generally corresponding to the width of side plates 32 and having an elongated slot 42. The end of latch 38 opposite to planar portion 40 is pivotally mounted to housing 14 such as by the axle for wheels 24 about a pivot axis spaced from and parallel to pivot pin 34.

In the most preferred form, device 36 according to the preferred teachings of the present invention includes a foot-operated lever 44 of a stamped, generally U-shape. In particular, lever 44 includes a central portion 46 of a generally rectangular, planar configuration. First and second legs 48 are bent to extend at a non-linear angle to the first and second edges of central portion 46 which is generally perpendicular in the most preferred form and extending upwardly from the upper surface of central portion 46 opposite to the lower surface of central portion 46. Legs 48 have a length generally equal to the length of central portion 46. The upper, free edges 50 of legs 48 are arranged at a small acute angle to central portion 46 in the order of 10°. Edges 50 are generally perpendicular to the faces of legs 48. A plurality of spaced, rectangular shaped notches 52 are cut in edge 50 of each leg 48. Notches 52 each include bottom wall 54 parallel to and spaced from edge 48. Notches 52 each further include first and second side walls 56 extending generally perpendicular between edge 50 and bottom walls 54. Lever 44 further includes first and second cam portions 58 integrally formed on and extending contiguously from the forward ends of legs 58, with cam portions 58 extending beyond the forward end of central portion 46. Circular openings 60 having an axis extending perpendicular to the faces of legs 48 and cam portions 58 are formed in each of cam portions 58.

Figure 5:
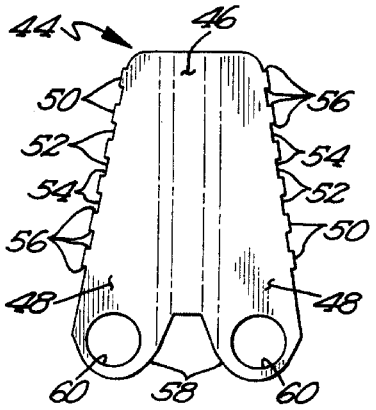
FIG. 5 shows a top plan view of a flat blank from which the foot-operated lever of the handle assembly of FIG. 1 is stamped, with the bend lines being shown as dotted lines.

According to the preferred teachings of the present invention, lever 44 is cut from a flat piece of sheet metal as shown in FIG. 5, with notches 52 and circular openings 60 formed therein. Lever 44 is formed by bending each leg 48 and integral cam portion 58 relative to central portion 46 about the dotted fold lines shown in FIG. 5. It should then be appreciated that forming lever 44 by stamping as opposed to casting greatly reduces capital costs including but not limited to costs for molds.

Device 36 generally includes a cylindrical spindle 62 having an outside surface of a diameter generally equal to is and for slideable and rotatable receipt in openings 60 of lever 44. Spindle 62 has a length generally equal to the spacing between the outside surfaces of legs 48 of lever 44. A cross bore 64 is provided in spindle 62 extending generally perpendicular to the axis of spindle 62.

Device 36 further includes a U-shaped bracket 66 having a rectangular-shaped central planar element 68. Element 68 has a width generally equal to the width of side plates 32 of handle tube 26. First and second, triangular-shaped, planar uprights or legs 70 extend at a non-linear angle to the first and second side edges of planar element 68 generally corresponding to the non-linear angle that legs 48 extend from central portion 46 which is generally perpendicular in the most preferred form, with cam portions 58 and planar portion 40 being slideably received between legs 70. Planar portion 40 of latch 38 is slideably received on planar element 68 intermediate legs 70. Additionally, the spacing between the inside surfaces of legs 70 are generally equal to and for slideable receipt of lever 44 and spindle 62. Planar element 68 includes an opening 72 located intermediate and having an axis parallel to legs 70.

Device 36 further includes a bolt 74, first and second washers 76 and 78, and a nut 80. In assembling device 36, after spindle 62 has been slid in openings 60 of lever 44, bolt 74 is extended through bore 64 to interconnect bolt 74 to cam portions 58 and lever 44 about the axis of circular openings 60 and spindle 62. Bolt 74 can then be extended through and slideable relative to washer 76, slot 42, opening 72, a bore 82 extending through side plates 32 of handle tube 26, and washer 78. Nut 80 is then threaded onto the free, threaded end of bolt 74 to generally sandwich the components together and particularly to sandwich planar portion 40 between central element 68 and cam portions 58. The side of washer 76 opposite to planar portion 40 forms an abutment surface against which cam portions 58 abut. According to the teachings of the present invention, legs 70 of bracket 66 have a height above planar element 68 to extend at least partially over openings 60 of lever 44 and over the axial ends of spindle 62 rotatably received in openings 60. Lever 44 is then pivotable upward from a first locking position extending generally perpendicular to side plate 32 of handle tube 26 to a second, unlocked position extending at an acute angle to side plate 32 and handle tube 26. Cam portions 58 position openings 60 and spindle 62 at varying spacing from the abutment surface of washer 76 and from side plate 32 and specifically increasing spacing as lever 44 is pivoted from the first, locking position to the second, unlocked position in the preferred form. It can then be appreciated that bolt 84 is placed under greater tensional forces and latch 38, lever 44, bracket 66 and handle tube 26 are placed under greater compressional or clamping forces with increased spacing of openings 60 and spindle 62 from washer 76 and side plate 32. It can then be appreciated that nut 80 can be threadably tightened on bolt 84 such that with lever 44 in the first, locking position, sufficient compression or clamping forces are placed on arm latch 38 between bracket 66 and washer 76 to prevent slideable movement or slippage therebetween and with lever 44 in the second, unlocked position, the compression or clamping forces on arm latch 38 between bracket 66 and washer 76 allow slideable movement or slippage therebetween. In this regard, the compression forces on arm latch 38 with lever 44 in the second, unlocked position should be sufficient to prevent unintentional slippage such as due to gravitational forces but allow slippage when an operator pushes or pulls on handle assembly 10 to adjust handle assembly 10 in the desired pivotable position relative to housing 14.

According to the preferred teachings of the present invention, the slideable receipt of spindle 62 in openings 60 maintains spindle 62 in position relative to lever 44 and specifically prevents rotation of spindle 62 on bolt 74 about bore 64 relative to lever 44. Further, the slideable receipt of planar portion 40 of arm latch 38 between legs 70 of bracket 66 positions bracket 66 relative to planar portion 40 and specifically prevents bracket 66 from rotating about opening 72 on bolt 74. Likewise, the slideable receipt of cam portions 58 between legs 70 positions lever 44 relative to bracket 66 and planar portion 40. Additionally, the abutment of legs 70 of bracket 66 on the outside surfaces of legs 48 of lever 44 and the axial ends of spindle 62 prevents lever 44 and spindle 62 from rotating about bore 64 while still allowing rotation of lever 44 about openings 60 on spindle 62. According to the preferred teachings of the present invention, planar portion 40 of arm latch 38 slides generally parallel to side plate 32 and the longitudinal axis of handle tube 26 in all pivotable positions of handle assembly 10 relative to housing 14. It can then be appreciated that bracket 66 thus maintains spindle 62 generally parallel to side plates 32 and perpendicular to plates 28 and 30 and the longitudinal axis of handle tube 26 in all pivotable positions of handle assembly 10 relative to housing 14 which then in turn maintains lever 44 pivotable about spindle 62 in a plane parallel to plates 28 and 30. Without bracket 66 and with bore 64 and bolt 74 having circular cross sections, lever 44 and spindle 62 could pivot about bolt 74 to any position when lever 44 was in its unlocked position which made its manipulation by the foot of the operator difficult and/or uncomfortable. Thus, preventing rotation of lever 44 and spindle 62 about bolt 74 is advantageous as lever 44 is maintained in the same plane relative to handle assembly 10 in all pivotable positions relative to housing 14 and lever 44 can not rotate out of this plane when pivoting from its unlocked position to its locked position by the foot of the operator.

It should also be appreciated that lever 44 is moved from its unlocked to its locked position by placing the sole of the shoe on the upper surface of lever 44 which is free edges 50 of legs 48 in the preferred form and pushing downward and is moved from its locked position to its unlocked position by placing the top of the shoe against the lower surface of lever 44 which is the lower surface of central portion 46 in the preferred form and pushing upward. It is currently very popular for operators to wear tennis or similar athletic shoes and thus scuffing and/or cutting of the tops of shoes from pushing up on handle locking levers has become a major concern. Prior to the present invention, this problem was alleviated by utilizing cast levers which are more costly to manufacture because of increased capital costs. Prior stamped levers included the central portion forming the upper surface and the edges of the legs forming the lower surface. To avoid scuffing and/or cutting the tops of shoes, such prior levers were often coated in plastic such as by a dipping process which increased the costs of manufacture. Lever 44 according to the teachings of the present invention is then advantageous in that formation is from a stamping process as opposed to a casting process which reduces mold and other manufacturing costs. Additionally, lever 44 according to the teachings of the present invention eliminates the need for coating as was required by prior stamped levers. This elimination arose as the result of reversing the conventional configuration of stamped levers and of providing notches 52 formed in edges 50 to aid in preventing the bottom or sole of the shoe from sliding or slipping thereon as may occur if edges 50 were not formed with notches 52. Lever 44 of the preferred form of the present invention then produces synergistic and advantageous results over heretobefore conventional practice in the field of floor maintenance machines.

Handle assembly 10 according to the preferred teachings of the present invention further includes a handle 84 formed of a foamed polymer such as nylon and in the most preferred form from glass-filled, foamed nylon. In the preferred form, handle 84 includes a top plate 86 having a generally planar outer surface and a bottom plate 88 having a generally planar outer surface parallel to and spaced from the planar outer surface of top plate 86. In the most preferred form, handle 84 is divided into a top section or portion 90 and a bottom section or portion 92 along a division line located intermediate plates 86 and 88.

Handle 84 according to the preferred teachings of the present invention generally includes tube interconnect section 94 of a hollow parallelepiped shape. Interconnect section 94 generally includes parallel side walls 96 extending generally perpendicular to the outer, perimeter edges of plates 86 and 88, with side walls 96 formed from portions 96*a* integrally formed with top plate 86 and portions 96*b* integrally formed with bottom plate 88. The spacing between the inside surfaces of side walls 96 is generally equal to and for slideable receipt of the outside surfaces of side plates 32. The spacing between the inside surfaces of plates 86 and 88 is generally equal to and for slideable receipt of the outside surfaces of plates 28 and 30. Thus, a socket for slideably receiving the upper end of handle tube 26 is defined by plates 86 and 88 and side walls 96 extending between plates 86 and 88. Interconnect section 94 further includes an end wall 98 extending generally perpendicular between side walls 96 and plates 86 and 88, with end wall 98 formed from portion 98*a* integrally formed with top plate 86 and portion 98*b* integrally formed with bottom plate 88. End wall 98 includes an integral electric cord passage 100 formed therein.

A plurality of securement bosses 102 upstand intermediate side walls 96 and intermediate end wall 98 and the free, perimeter edges of plates 86 and 88, with bosses 102 formed from portions 102*a* integrally formed with top plate 86 and portions 102*b* integrally formed with bottom plate 88. In the preferred form, portions 102*a* include embedded nuts for threadably receiving pin connectors extending through portions 102*b*. Handle tube 26 includes a plurality of bores 104 extending through plates 28 and 30 for slideably receiving boss portions 102*a* and 102*b*. Bottom portion 92 further includes trapezoid-shaped extensions 106 extending coextensively from side wall portions 96b on the opposite side of bottom plate 88 than top plate 86. Extensions 106 include edges 108 extending at an acute angle to the outer surface of bottom plate 88 in the order of 10°, with edges 108 having an increased spacing from bottom plate 88 from end wall 98 towards the free edge of plates 86 and 88.

Handle 84 according to the preferred teachings of the present invention further includes an electrical actuation section 110 having a hollow interior with cross sections parallel to the outer surfaces of plates 86 and 88 being hexagonal in shape. Actuation section 110 generally includes first and second side walls 112 extending generally perpendicular between the outer, perimeter edges of plates 86 and 88 and extending at an obtuse angle outwardly from side walls 96 in the order of 140°, with side walls 112 formed from portions 112*a* integrally formed with top plate 86 and portions 112*b* integrally formed with bottom plate 88. Actuation section 110 further includes third and fourth side walls 114 extending generally perpendicular between the outer, perimeter edges of plates 86 and 88 and extending at an obtuse angle inwardly from side walls 112 in the order of 130°, with side walls 114 formed from portions 114*a* integrally formed with top plate 86 and portions 114*b* integrally formed with bottom plate 88. Plates 86 and 88 in actuation section 110 extend beyond the ends of side walls 114 in a direction opposite to side walls 112 approximately the length of side walls 114. Partitions 116 extend generally perpendicular between plates 86 and 88 and extend at an obtuse angle inwardly from side walls 114 in the order of 125°, with partitions 116 formed from portions 116*a* integrally formed with top plate 86 and portions 116*b* integrally formed with bottom plate 88. The free ends of partitions 116 are spaced from each other.

First and second, cylindrical pivot bosses 118 upstand intermediate the edges of plates 86 and 88, with pivot bosses 118 formed from portions 118*a* integrally formed with top plate 86 and portions 118*b* integrally formed with bottom plate 88. The axes of pivot bosses 118 are in a spaced, parallel relation and define a plane which is parallel to end wall 98. Bosses 118 are located on the opposite side of partitions 116 than end wall 98, with the free ends of partitions 116 located adjacent to and spaced from the periphery of pivot bosses 118. In the most preferred form, boss portions 118*a* include embedded nuts for threadably receiving pin connectors extending through boss portions 118*b*.

First and second, pivotable triggers 120 are provided in actuation section 110 which are of identical construction in the most preferred form. Specifically, each trigger 120 includes a collar 122 of a size and shape for pivotable receipt on pivot bosses 118 which define a pivot axis for trigger 120. Extending generally radially from the pivot axis of collar 122 is a lever portion 124. An actuator portion 126 extends radially from the axis of collar 122 diametrically opposite to lever portion 124. First and second teeth 128 extend radially from the free end of actuator portion 126, with teeth 128 being axially and circumferentially spaced on the free end of actuator portion 126. An ear 130 extends radially from the pivot axis of collar 122 generally opposite to lever portion 124 and at an acute angle to actuator portion 126. Ear 130 terminates in a face 132 including a detent 134 having V-shaped cross sections extending parallel to the axis of collar 112.

Triggers 120 are assembled in actuation section 110 by sliding collars 122 onto pivot bosses 118 with lever portions 124 extending in opposite directions. Teeth 128 of first and second triggers 120 are in a gearing relation such that pivotable movement of one of the first and second triggers 120 about its respective pivot boss 118 causes simultaneous pivotable movement of the other of the first and second triggers 120 about the other pivot boss 118. The spacing between faces 132 of triggers 120 in the preferred form decrease as triggers 120 pivot from an off position to an actuation position.

Actuation section 110 further includes a switch 136 mounted in suitable mounts 138 integrally extending from top and bottom plates 86 and 88. A spring plate 140 extends from one of the partitions 116 for biasing triggers 120 into the off position and for actuating switch 136 in the actuation position. In the most preferred form, the free ends of partitions 116 include surfaces in slideable contact with collars 122 intermediate portions 124 and 126 such that a hollow interior for switch 136 is defined and closed by end wall 98, side walls 112 and 114, partitions 116, and triggers 120.

In the most preferred form, one of the side walls 112 includes an integral electric cord passage and strain relief member 142. In particular, member 142 is formed by a block of material extending between plates 86 and 88 and from side wall 112, with portion 142*a* integrally formed with top plate 86 and portion 142*b* integrally formed with bottom plate 88. Member 142 generally includes a cone-shaped port 144 extending from the outside surface of side wall 112 and terminating in a cylindrically shaped port 146 extending to the inside surface of member 142. In particular, port 144 has circular cross sections of a decreasing size with increasing spacing from the outside surface of side wall 112 and in the most preferred form in a non-linear manner such that port 144 has arcuate-shaped axial cross sections. Port 146 has circular cross sections of a constant diameter equal to the diameter of port. 144 at their interconnection.

Handle 84 according to the preferred teachings of thee present invention further includes a hand grip section 150. Section 150 includes side walls 152 which extend in the same plane as side walls 114 but spaced therefrom at a location generally equal to the outer periphery of bosses 118 opposite to the free ends of partitions 116. Side walls 152 are formed from portions 152*a* integrally formed with top plate 86 and portions 152*b* integrally formed with bottom plate 86, with portions 152*a* having a height substantially greater than portions 152*b*. Section 150 further includes end wall 154 extending generally perpendicular between the perimeter edges of plates 86 and 88 and integrally connected to and between the upper ends of side walls 152 and extending generally parallel to and spaced from end wall 98. End wall 154 is formed from portion 154*a* integrally formed with top plate 86 and portion 154*b* integrally formed with bottom plate 88, with portion 154*a* having a height substantially greater than portion 154*b*. Hand grips 156 are integrally formed solely with and extend outwardly from side wall portions 152*a* and generally parallel to end wall portion 154*a*. In the most preferred form, hand grips 156 are of a solid, unitary material construction having generally circular cross sections and particularly having the outer configuration of a standard configuration for comfortable gripping in the hands of the operator and specifically including an outer, continuous surface adapted to be engaged by fingers of an operator wrapped thereon. In the preferred form shown, hand grips 156 do not integrally extend between side walls 152. Side walls 152 further include an integral extension 158 on the side opposite from hand grips 156 and integrally extending from top and bottom plates 86 and 88. Extensions 158 are formed from portions 158*a* integrally formed with top plate 86 and portions 158*b* integrally formed with bottom plate 88. Extension portions 158*a* and 158*b* in the preferred form have a height generally equal to side wall portions 152*a* and 152*b*, respectively. In the preferred form, the lower, inside corner of extensions 158 terminates in surfaces in slideable contact with collars 122 intermediate portions 124 and ears 130 such that a hollow interior is defined and closed by extensions 158, side walls 152, end wall 154, and triggers 120.

The free edges of portions 158*a* which abut with the free edge of portions 158*b* each include a non-cylindrical bore 160 such as T-shaped as shown extending generally parallel to bosses 118. The free edges of portions 158*b* each include a projection 162 of a size, shape and location for slideable receipt in bores 160. In the most preferred form, plates 86 and 88 can have a greater thickness in section 150 than in sections 94 and 110.

Handle 84 according to the preferred teachings of the present invention further includes a lock-out device 164 for preventing unintentional pivoting of triggers 120. Device 164 includes an inverted T-shaped body having a leg 166 having its lower end integrally connected perpendicular to a head 168. Head 168 includes parallel outer edges 170 having an indent 172 of a shape and size for slideable receipt of detents 134 of triggers 120. Edges 170 are spaced for slideable receipt between and abutment with faces 132 of triggers 120 in their off position. Leg 166 is located intermediate to edges 170. Leg 166 has I-shaped cross sections defining first and second troughs extending in a straight linear direction. An enlarged button 174 is integrally connected perpendicular to the upper end of leg 166. First and second, flexible wings 176 extend from diametrically opposite sides of leg 166 intermediate its upper and lower ends and generally parallel to head 168 in their normal position.

End wall portion 154*a* includes a channel 178 for slideably receiving leg 166 of device 164 intermediate button 174 and wings 176. Device 164 moves in a straight linear direction perpendicular to the plane defined by the pivot axes of triggers 120 defined by bosses 118 between a lock-out position and a release position. A suitable button guard 180 can be provided in the outside surface of portion 154*a*. End wall portion 154*b* includes a protrusion 182 for slideable receipt in channel 178 above leg 166 of device 164. Projections 184 are formed in channel 178 and upon protrusion 182 for receipt in the troughs defined by the I-shaped cross sections of leg 166 for slideably mounting device 164 in the straight linear direction.

Now that the construction of handle 84 according to the preferred teachings of the present invention have been set forth, the operation and some of the advantages of handle 84 can be explained and appreciated. In an assembled relation, triggers 120 are pivotable between an off position and an actuated position, with triggers 120 being biased to their off position by spring plate 140. In the actuated position, triggers 120 generally engage hand grips 156 along their entire length such that the hand(s) of the operator can comfortably hold trigger 120 and hand grip 156 together. In the off position, triggers 120 are at an acute angle relative to hand grips 156 such that the free ends of triggers 120 and hand grips 156 are spaced. In the off position, faces 132 of ears 130 of triggers 120 are in a generally spaced parallel relation.

In an assembled relation, device 164 is slideable between the safety or lock-out position with button 174 spaced from end wall 154 and the release position with button 174 moved towards end wall 154. In the preferred form, the free ends of wings 176 are positioned on the upper end of extensions 158 and in the lock-out position of device 164 extend in their normal position from leg 166 which in the preferred form is generally perpendicular to leg 166 and the straight linear direction of movement of device 164. It can then be appreciated that when device 164 is slid from the lock-out position by pushing downward on button 174, wings 176 are deflected from their normal position and due to their resiliency has a tendency to return to their normal position. Thus, wings 176 bias device 164 from its release position towards its lock-out position. In the lock-out position, head 168 is located between ears 130 of triggers 120 in their off position with edges 170 abutting with faces 132 and detents 134 positioned in indents 172. With head 168 located between ears 130, triggers 120 are unable to pivot about bosses 118 from their off position. Thus, device 164 in the lock-out position prevents unintentional pivoting of triggers 120. It should be appreciated that positioning detents 134 in indents 172 prevents head 168 from slipping or otherwise moving between ears 130 which can occur such as by rapidly and repeatedly squeezing triggers 120 towards hand grips 156.

When it is desired to actuate maintenance machine 12, device 164 is slid in the straight linear direction towards the plane defined by the pivot axes of triggers 120 from its lock-out position to its release position by pushing button 174 towards end wall 154 against the bias of wings 176. With device 164 in its release position, head 168 is positioned below faces 132 such that ears 130 can pivot towards each other as triggers 120 are pivoted towards hand grips 156 from their off position to the actuation position. Once triggers 120 are pivoted from their off position, button 174 can be released with wings 176 moving device 164 towards its lock-out position. However, the upper surface of head 168 will abut with the lower surface of ears 130 to prevent movement of device 164 therebeyond. Thus, it is not necessary for the operator to continuously hold button 174 down when operating machine 12 according to the teachings of the present invention. However, if triggers 120 are ever released returning to their off position under the bias of spring plate 140, the upper surface of head 168 no longer abuts with ears 130 and device 164 will return to its lock-out position with head 168 positioned between faces 132. Thus, it will again be necessary to depress button 174 when it is desired to pivot triggers 120. It should further be appreciated that due to the gearing relation between teeth 128, triggers 120 pivot together such that either one or both triggers 120 can be pivoted from the off position to the actuation position to actuate machine 10.

Figure 6:
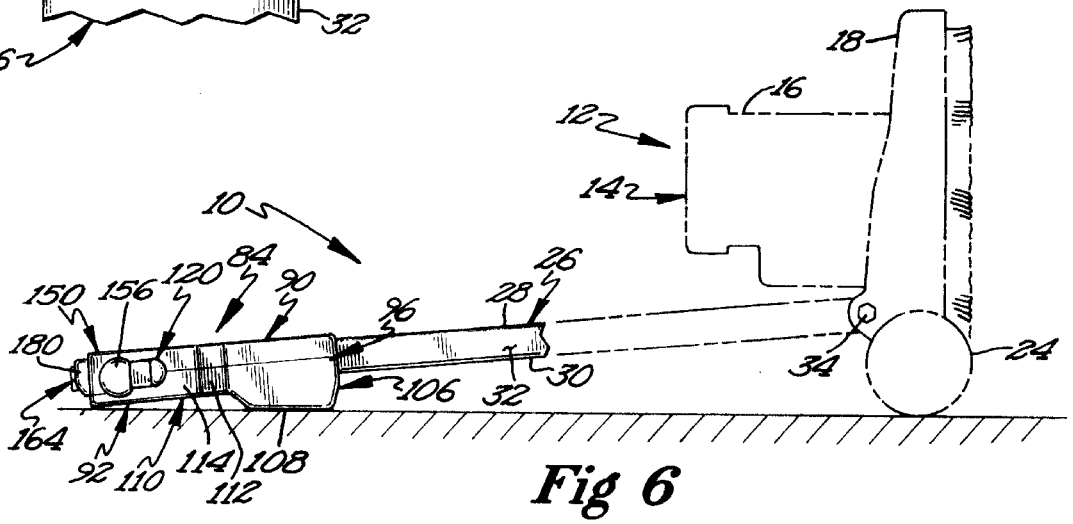
FIG. 6 shows a diagrammatic, side view of the floor maintenance machine of FIG. 1 tipped to engage the free end of the handle assembly with the floor, with portions shown in phantom.

Prior to the present invention, if floor maintenance machine 12 tipped, the free end of handle 84 defined in the preferred form by end wall 154 would engage the floor. This engagement especially if with sufficient force often resulted in handles made of polymers cracking at the upper end of handle tube 26 defined in the preferred form in the vicinity of end wall 98. Such tipping can be a common occurrence as the result of accidentally bumping machine 12 such as with another floor maintenance machine or unintentional release of machine 12 when tilting machine 12 for replacing or inspecting the rotary floor maintenance element surrounded by base section 18. It should then be noted in the most preferred form, extensions 106 act as protrusions on interconnection section 94 with edges 108 flushly abutting the floor when the free end of handle 84 defined by end wall 154 engages the floor as shown in FIG. 6 when handle assembly 10 is tipped for preventing handle 84 from engaging the floor solely at the free end of handle 84 defined by end wall 154. Thus, the engagement forces of handle 84 hitting the floor are transferred to interconnection section 94 by extensions 106 and then to tube 26 below its upper end and thus significantly reducing the risk of handle 84 cracking at the upper end of handle tube 26 in the vicinity of end wall 98.

The use of polymers and other non-metallic materials in handle assemblies 10 has been known in the field of floor maintenance machines 12. However, such non-metallic materials were generally injection molded into thin wall configurations. Further, if the hand grips were formed of non-metallic material, they were generally longitudinally split into halves and were assembled together on opposite sides of a metal brace. In addition, such hand grips often included a rubber sleeve slid over the hand grips to prevent pinching between the hand grip halves.

Handle 84 according to the preferred teachings of the present invention does not utilize molding into thin wall configurations and specifically utilizes fabrication of portions 90 and 92 from a solid, unitary material which is a foamed polymer in the preferred form and glass-filled foamed nylon in the preferred form. In this regard, although metals can be cast in other than thin wall configurations, metals tend to shrink when hardening and thus do not provide a desirable outer appearance as shrinkage is greater where the casting is thicker, producing shrink pockets. Thus, metal cast components were often of thin wall configurations and if not, often required exterior coverings to cover its outer appearance. It can then be appreciated that fabrication of portions 90 and 92 from solid material of varying thickness according to the preferred teachings of the present invention is advantageous. First, hand grips 156 can be fabricated as a single piece having sufficient strength not requiring metal braces. Handle assembly 10 according to the teachings of the present invention is then especially advantageous as the amount of assembly including the number of components such as connectors and exterior coverings and sleeves is significantly reduced. In addition, in the preferred form where hand grips 156 do not integrally extend between side walls 152, there can be a tendency for breakage at the interconnection of side walls 152 to plate 86 or at the center of plate 86 due to deformation of side wall 152 by torque forces thereon as the result of gripping grips 156 outwardly thereof. According to the preferred teachings of the present invention, such deformation is resisted by the interconnection provided by projections 162 of bottom portion 92 being slideably received in bores 160 to prevent the top edges of portions 158*a* from moving relative to each other. Thus, due to this interconnection, plates 86 and 88 provide reinforcement to extensions 158 to reduce any tendency for breakage of the interconnection of side walls 152 to plate 86 and/or of plate 86. In this regard, the thickness of plate 86 and/or 88 can be increased in hand grip section 150 to maximize this breakage protection.

Also, formation from a foamed polymer allows formation of passage 100, relief 142 and bosses 102 and 118 (as well as different thickness plates 86 and/or 88) while still maintaining a generally planar, aesthetic outer surface on plates 86 and 88. Thus, coverings or the like are not required, further reducing component costs and assembly requirements.

It can then be appreciated that handle 84 according to the teachings of the present invention is advantageous in significantly reducing the number of components over prior constructions. In this regard, in addition to hand grips 156 being formed solely with top portion 90, device 164 is formed as a single piece with the bias providing wings 176 integrally formed. Thus, assembly of device 164 is not required and device 164 is assembled in handle 84 by mere placement in top portion 90. Similarly, electric cords can be similarly placed in passage 100 and relief member 142, switch 136 placed in mounts 138, triggers 120 placed on bosses 118, and spring plate 140 placed in the end of partition 116*a*, with attachment not required as the components are sandwiched in place when portions 90 and 92 are secured together. Thus, handle 84 according to the preferred teachings of the present invention is easy to assemble.

The electric cords for handle assembly 10 shown in the figures have been omitted for ease of illustration. Handle assembly 10 could include suitable provisions for wrapping the electric cord thereon when machine 12 is not in use. In this regard, lever 44 and/or extensions 106 can be utilized for such purposes.

Now that the basic teachings of the present invention have been explained, many extensions and variations will be obvious to one having ordinary skill in the art. For example, although locking device 36 of the preferred form clamps handle tube 26 by sandwiching components together, clamping forces can be applied to handle tube 26 by other manners including but not limited to collapsing slideable collars on handle tube 26.

Likewise, although handle assembly 10 of the most preferred form includes several unique features believed to produce synergistic results, it can be appreciated that such features can be utilized singly or in other combinations in a handle assembly according to the preferred teachings of the present invention.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

We claim:

1. Device for adjustably locking a handle in one of a plurality of pivotable positions relative to a housing, with the handle being pivotally mounted to the housing, comprising, in combination: means for placing a clamping force on the handle including a bolt slideable relative to an abutment surface; and a foot-operated lever of a generally U-shape, with the lever including a central portion having first and second edges and upper and lower surfaces, first and second legs integrally extending at a non-linear angle from the first and second edges, with the first and second legs each having a free, upper edge and a front end, and a cam portion formed on the front end of each of the first and second legs, with the bolt being interconnected to the cam portions at an axis, with the cam portions abutting with the abutment surface, with the spacing of the axis from the abutment surface decreasing with pivotable movement of the cam portions about the axis by pushing the lower surface of the central portion by the top of the foot to reduce the clamping force on the handle and the spacing of the axis from the abutment surface increasing with pivotable movement of the cam portions about the axis by pushing the free edges of the legs by the bottom of the foot to increase the clamping force on the handle, with the first and second legs being bent relative to the central portion by stamping.

2. The adjustably locking device of claim 1 wherein the free, upper edges of the first and second legs include notches formed therein to aid in preventing sliding of the bottom of the foot when pushing against the free edges of the legs.

3. The adjustably locking device of claim 1 wherein the placing means further comprises, in combination: a generally U-shaped bracket including a central element having first and second edges and first and second uprights extending at the non-linear angle from the first and second edges of the central element, with the cam portions being slideably received between the first and second uprights; an arm latch having a first end pivotally mounted to the housing and having an elongated portion including a slot for slideably receiving the bolt, with the elongated portion being slideable between the first and second uprights and sandwiched between the central element and the cam portions, with the central element including an opening for slideably receiving the bolt, with the slideable receipt of the elongated portion between the first and second uprights positioning the U-shaped bracket relative to the elongated portion and the slideable receipt of the cam portions between the first and second uprights positioning the lever relative to the U-shaped bracket and the elongated portion.

4. The adjustably locking device of claim 3 wherein the cam portions each include a circular opening formed on the axis and having a diameter; and wherein the placing means further comprises, in combination: a cylindrical spindle having first and second axial ends and having a diameter equal to the diameters of the circular openings, with the spindle being slideably and rotatably received in the circular openings; and a cross bore formed in the cylindrical spindle for slideably receiving the bolt, with the first and second axial ends being slideably received between the first and second uprights, with the cam portions including the cylindrical spindle slideably received in the circular openings being slideably received between the first and second uprights to prevent the cylindrical spindle from axially sliding from the circular openings.

5. Clamping device comprising, in combination: a bolt; a generally U-shaped bracket including a central element having first and second edges and first and second uprights extending at a non-linear angle from the first and second edges of the central element, with the central element including an opening for slideably receiving the bolt; an elongated portion including a slot for slideably receiving the bolt, with the elongated portion being slideable between the first and second uprights; and a lever including a cam portion for slideable receipt between the first and second uprights, with the bolt being interconnected to the cam portion about an axis, with the elongated portion being sandwiched between the cam portion and the central element, with pivoting of the lever about the axis varying a tensional force on the bolt, with the slideable receipt of the elongated portion between the first and second uprights positioning the U-shaped bracket relative to the elongated portion and the slideable receipt of the cam portion between the first and second uprights positioning the lever relative to the U-shaped bracket and the elongated portion.

6. The clamping device of claim 5 further comprising, in combination: a cylindrical spindle having first and second axial ends and having a diameter, with the cam portion including a circular opening formed on the axis and having a diameter equal to and for slideably and rotatably receiving the spindle; and a cross bore formed in the cylindrical spindle for slideably receiving the bolt, with the first and second axial ends being slideably received between the first and second uprights to position the spindle relative to the lever, with the cam portion including the cylindrical spindle slideably received in the circular opening being slideably received between the first and second uprights to prevent the cylindrical spindle from axially sliding from the circular opening.

7. Handle for a floor maintenance machine comprising, in combination: first and second triggers pivotable about first and second parallel axes between an off position and an actuation position, with each of the triggers including a face, with the spacing between the faces of the first and second triggers decreasing as the first and second triggers pivot from the off position to the actuation position; a lock-out device including a head having first and second edges, with the first and second edges being spaced for slideable receipt between and abutment with the first and second faces, with the lock-out device being slideably mounted for movement in a straight, linear direction perpendicular to a plane defined by the axes of the first and second triggers between a lock-out position and a release position, with the head in the lock-out position located between the faces when the triggers are in the off position with the first and second edges abutting with the faces to prevent pivoting of the first and second triggers from the off position, with the lock-out device movable toward the plane from the lock-out position to the release position with the first and second edges in a nonabutting position with the faces allowing pivoting of the first and second triggers to the acutation position; and means for biasing the lock-out device from the release position to the lock-out position.

8. The handle of claim 7 wherein the biasing means comprises wings integrally formed with the lock-out device, with the wings flexing as the lock-out device moves from the lock-out position to the release position.

9. The handle of claim 7 further comprising, in combination: means for pivotally relating the first, and second triggers such that pivoting of one of the first and second triggers results in the simultaneous pivoting of the other of the first and second triggers, with the head abutting the triggers when the lock-out device is in the release position and the triggers are in the actuation position to prevent the lock-out device from moving to the lock-out position under the bias of the biasing means.

10. The handle of claim 7 wherein the lock-out device further includes a leg extending in the straight linear direction from the head intermediate the first and second edges, with the leg having I-shaped cross sections perpendicular to the straight linear direction defining first and second troughs extending in the straight linear direction for receiving projections elongated in the straight linear direction for slideably mounting the lock-out device in the straight linear direction.

11. The handle of claim 7 wherein one of the faces and the edges includes a detent and the other of the faces and the edges includes an indent for slideably receiving the detent for preventing unintentional movement of the lock-out device from the lock-out position towards the release position.

12. Handle for a floor maintenance machine comprising, in combination: first and second triggers pivotable about first and second parallel axes between an off position and an actuation position, with each of the triggers including a face; a lock-out device including first and second edges, with the lock-out device being movable between a lock-out position and a release position, with the first and second edges in the lock-out position abutting with the faces of the first and second triggers in the off position to prevent pivoting of the triggers from the off position to the acutation position and with the triggers being allowed to pivot from the off position to the acutation position when the lock-out device is in the release position; and wings integrally formed with the lock-out device, with the wings flexing as the lock-out device moves from the lock-out position to the release position for biasing the lock-out device from the release position.

13. The handle of claim 12 wherein the lock-out device moves in a straight linear direction between the lock-out position and the release position; and wherein the wings extend from the lock-out device generally perpendicular to the straight linear direction in an unflexed condition.

14. Handle assembly for a machine for maintaining a floor, with the floor maintenance machine including a housing, comprising, in combination: a pole having a lower end and an upper end, with the lower end being pivotally mounted to the housing at a location spaced from the floor; a handle including an interconnection section and a further section, with the interconnection section being secured to the upper end of the pole with the further section extending beyond the upper end of the pole in a direction opposite to the lower end and including a free end; and means for preventing the handle from engaging the floor solely at the free end.

15. The handle assembly of claim 14 wherein the preventing means comprises at least a first protrusion formed on the interconnection section having an edge for engaging the floor, with the edge flushly abutting the floor when the free end abuts the floor.

16. The handle assembly of claim 14 wherein the interconnection section is defined by a socket for slideably receiving the upper end of the pole, with the socket defined by a top plate, a bottom plate, and first and second side walls extending between the top and bottom plates, with the preventing means further comprising, in combination: a second protrusion, with the first and second protrusions formed by an extension of the first and second side walls beyond the bottom plate in a direction opposite to the top plate.

17. Handle for a floor maintenance machine comprising, in combination: a housing defining a hollow interior and including at least first and second side walls located on opposite sides of the housing, with the housing being divided into a top section and a bottom section, with the first and second side walls being divided into top portions integrally formed with the top section and bottom portions integrally formed with the bottom section; and first and second hand grips integrally formed solely with the top portions of the respective first and second side walls and extending in opposite directions therefrom.

18. The handle of claim 17 wherein the hand grips include an outer surface adapted to be engaged by fingers of an operator wrapped thereon, with the hand grips being formed of a solid, unitary material with the outer surface being continuous, with the solid, unitary material being a foamed polymer.

19. The handle of claim 17 wherein the first and second hand grips do not integrally extend between the first and second side walls; wherein the top section includes a top plate with the top portions integrally formed with the top plate and the bottom section includes a bottom plate with the bottom portions integrally formed with the bottom plate; and wherein the handle further comprises, in combination: first and second extensions integrally formed with the top portions opposite to the first and second hand grips and having free edges opposite to the top plate; a bore extending from the free edges and having a shape; and first and second projections for slideable receipt in the bores, with the bores formed in one of the extensions and the bottom plate and the projections formed in the other of the extensions and the bottom plate.

20. The handle of claim 19 further comprising, in combination: first and second pivot bosses extending between the top and bottom plates; and first and second triggers having annular collars for rotatable receipt on the pivot bosses, with the first and second extensions including a surface for abutting with and slideable receipt on the collars of the respective first and second triggers.

21. Handle assembly for a machine for maintaining a floor, with the floor maintenance machine including a machine housing, comprising, in combination: a pole having a lower end and an upper end, with the lower end of the pole being pivotally mounted to the machine housing at a location spaced from the floor; a foot-operated lever of a generally U-shape, with the lever including a central portion having first and second edges and upper and lower surfaces, first and second legs integrally extending at a non-linear angle from the first and second edges, with the first and second legs each having a free, upper edge and a front end, and a cam portion formed on the front end of each of the first and second legs; means for placing a clamping force on the pole including a bolt interconnected to the cam portions at an axis, a generally U-shaped bracket including a central element having first and second edges and first and second uprights extending at the non-linear angle from the first and second edges of the central element, with the central element including an opening for slideably receiving the bolt, and an arm latch having a first end pivotally mounted to the machine housing and having an elongated portion including a slot for slideably receiving the bolt, with the elongated portion being slideable between the first and second uprights, with the slideable receipt of the elongated portion between the first and second uprights positioning the U-shaped bracket relative to the elongated portion and the slideable receipt of the cam portions between the first and second uprights positioning the lever relative to the U-shaped bracket and the elongated portion with the elongated portion being sandwiched between the cam portions and the central element, with the spacing of the axis from the central element decreasing with pivotable movement of the cam portions about the axis by pushing the lower surface of the central portion by the top of the foot to reduce the clamping force on the pole and the spacing of the axis from the central element increasing with pivotable movement of the cam portions about the axis by pushing the free edges of the legs by the bottom of the foot to increase the clamping force on the pole, with the first and second legs being bent relative to the central portion by stamping; a handle housing defining a hollow interior and including at least first and second side walls located on opposite sides of the handle housing, with the handle housing being divided into a top section and a bottom section, with the first and second side walls being divided into top portions integrally formed with the top section and bottom portions integrally formed with the bottom section, with the top section including a top plate with the top portions integrally formed with the top plate and the bottom section including a bottom plate with the bottom portions integrally formed with the bottom plate; first and second hand grips integrally formed solely with the top portions of the respective first and second side walls and extending in opposite directions therefrom, with the first and second hand grips not integrally extending between the first and second side walls; first and second extensions integrally formed with the top portions opposite to the first and second hand grips and having free edges opposite to the top plate; a bore extending from the free edges of the extensions and having a shape; first and second projections for slideable receipt in the bores, with the bores formed in one of the extensions and the bottom plate and projections formed in the other of the extensions and the bottom plate, first and second triggers pivotable about first and second parallel pivot bosses between an off position and an actuation position, with each of the triggers including a face, with the spacing between the faces of the first and second triggers decreasing as the first and second triggers pivot from the off position to the actuation position; a lock-out device including a head having first and second edges, with the first and second edges being spaced for slideable receipt between and abutment with the first and second faces, with the lock-out device being slideably mounted between the first and second extensions and for movement in a straight, linear direction perpendicular to a plane defined by the bosses of the first and second triggers between a lock-out position and a release position, with the head in the lock-out position located between the faces when the triggers are in the off position with the first and second edges abutting with the faces to prevent pivoting of the first and second triggers from the off position, with the lock-out device movable toward the plane from the lock-out position to the release position with the first and second edges in a nonabutting position with the faces allowing pivoting of the first and second triggers to the acutation position; wings integrally formed with the lock-out device, with the wings flexing as the lock-out device moves from the lock-out position to the release position for biasing the lock-out device from the release position, with the handle housing further including an interconnection section secured to the upper end of the pole, with the handle housing extending beyond the upper end of the pole in a direction opposite to the lower end and including a free end; and means for preventing the handle housing from engaging the floor solely at the free end.

* * * * *